US012680285B2

(12) United States Patent
Liao et al.

(10) Patent No.: US 12,680,285 B2
(45) Date of Patent: Jul. 14, 2026

(54) SPLIT ANTI-CLOGGING DRAIN DEVICE

(71) Applicant: CLEMENT INC., Flushing, NY (US)

(72) Inventors: Xingfa Liao, Xiamen (CN); Chunhua Wang, Xiamen (CN); Yongqiang Yan, Fuzhou (CN)

(73) Assignee: CLEMENT INC., Flushing, NY (US)

( * ) Notice: Subject to any disclaimer, the term of this patent is extended or adjusted under 35 U.S.C. 154(b) by 139 days.

(21) Appl. No.: 18/773,594

(22) Filed: Jul. 16, 2024

(65) Prior Publication Data

US 2026/0022544 A1 Jan. 22, 2026

(51) Int. Cl.
*E03C 1/264* (2006.01)
*E03C 1/262* (2006.01)

(52) U.S. Cl.
CPC ..... *E03C 1/264* (2013.01); *E03C 1/262* (2013.01)

(58) Field of Classification Search
CPC ..... A47K 1/14; E03C 1/2306; E03C 1/264; E03C 1/262; E03C 2001/2317
See application file for complete search history.

(56) References Cited

U.S. PATENT DOCUMENTS 6,219,861 B1 * 4/2001 Chen ..... E03C 1/23 4/689
6,442,770 B1 * 9/2002 Lin ..... A47K 1/14 4/286
6,880,179 B2 * 4/2005 Wang ..... A47K 1/14 4/286
11,066,820 B1 * 7/2021 Yang ..... E03C 1/2306

FOREIGN PATENT DOCUMENTS

KR 20080001524 U * 6/2008 ..... E03C 1/2306
KR 200472123 Y1 * 4/2014 ..... E03C 1/2306

* cited by examiner

*Primary Examiner* — Erin Deery

(57) ABSTRACT

The present disclosure relates to the technical field of bathroom accessories and provides a split anti-clogging drain device which includes a main body and a sealing assembly detachably connected to the main body. The sealing assembly includes a switch assembly arranged inside the main body and a sealing stopper arranged at an opening of the main body and located above the switch assembly. By pressing down the sealing stopper, the sealing stopper is repeatedly switchable between a sealed state and a drainage state under an action of the switch assembly. The anti-clogging drain device of the present disclosure is provided with a detachable sealing assembly, and is provided with a filter ring on an outer side of the switch assembly. When impurities enter the drainage channel, the sealing assembly can be detached to remove the impurities, so as to prevent clogging of the water passage.

13 Claims, 7 Drawing Sheets

SPLIT ANTI-CLOGGING DRAIN DEVICE

TECHNICAL FIELD

The present disclosure relates to the technical field of bathroom accessories, in particular to a split anti-clogging drain device.

BACKGROUND

In places such as bathrooms, bathtubs, washbasins or sinks, drain device which is also called drainage rod is desirable to realize water storage or drainage. There are many types of drain devices, and the types that are commonly seen on the market include flip stopper drain device, pop-up drain device, lift drain device and drain device with lift wire. However, the sealing assembly in some existing pop-up drain devices are not detachable or are difficult to detach, and these drain devices have no impurities or hair barrier structure. Most impurities can directly flow down to the sewer through the drainage channel. In particular, when small-sized valuable items fall into the drainage channel, they will flow down to the sewer with the water flow and cannot be stopped/blocked in time, which can easily cause loss of items.

SUMMARY

The present disclosure aims to solve the above-mentioned technical problem and provides a split anti-clogging drain device to overcome the existing drawbacks. The present disclosure provides the following solutions.

A split anti-clogging drain device comprises a main body and a sealing assembly detachably connected to the main body;

wherein the sealing assembly comprises a switch assembly arranged inside the main body and a sealing stopper arranged at an opening of the main body and located above the switch assembly; by pressing down the sealing stopper, the sealing stopper is repeatedly switchable between a sealed state and a drainage state under an action of the switch assembly.

Furthermore, a drainage channel is formed between the switch assembly and the main body, and an outer sidewall of the switch assembly is provided with a filter ring for filtering impurities.

Furthermore, the switch assembly comprises a base; a switching seat, wherein the switching seat is arranged inside the base and is movably connected to the base; a switching rod, wherein a bottom part of the switching rod is rotatably connected to the base and an upper part of the switching rod is movably connected to the switching seat; and a spring, wherein the spring is arranged between a bottom part of an inner side of the base and the switching seat; the sealing stopper is arranged on the switching seat, an outer sidewall of the switching seat is provided with a switching recess, the switching recess is internally provided with a switching step, a bottom part of the switching recess is provided with a first clamping groove, and an upper end of the switching step is provided with a second clamping groove; the spring continuously stores elastic potential energy, and an upper end of the switching rod is provided with a hook portion, when the hook portion is located in the first clamping groove, a gap is formed between the sealing stopper above the switching seat and the opening of the main body, which is the drainage state, when the hook portion is located in the second clamping groove, the switching seat moves downward, and the sealing stopper above the switching seat is situated in the opening of the main body, which is the sealed state.

Furthermore, the sealing stopper is connected to the switching seat by threads.

Furthermore, a first switching channel and a second switching channel are respectively formed between the switching recess and the switching step on two sides of the switching step; when the upper end of the switching rod moves downward along the first switching channel to the first clamping groove, the sealing stopper being in the drainage state; when the switching rod moves upward along the second switching channel to the second clamping groove, the sealing stopper being in the sealed state.

Furthermore, the first switching channel includes a first guide surface and a second guide surface, and the second switching channel includes a third guide surface and a fourth guide surface. A joint between each pair of guide surfaces that are adjacent to each other among the first guide surface, the second guide surface, the third guide surface and the fourth guide surface forms an inward drop, namely, a first inward drop is formed at the joint between the first guide surface and the second guide surface, a second inward drop is formed at the joint between the second guide surface and the third guide surface, a third inward drop is formed at the joint between the third guide surface and the fourth guide surface, and a fourth inward drop is formed at the joint between the fourth guide surface and the first guide surface.

Furthermore, a ferrule is provided on the base and the ferrule is located below the switching rod, and a first sealing ring is provided between an outer sidewall below the base and an inner sidewall of the main body.

Furthermore, the filter ring is arranged on the outer sidewall of the base in the drainage channel, and the filter ring is connected to the outer sidewall of the base via a plurality of connection columns.

Furthermore, an outer sidewall of the filter ring is provided with a plurality of positioning steps, and the positioning steps are in interference fit with an inner sidewall of the main body.

Furthermore, a second sealing ring is sleeved on an outer sidewall of the sealing stopper.

Furthermore, an outer sidewall of the main body is also provided with a locking member connected thereto.

Furthermore, the locking member is connected to the main body by threads, an outer sidewall of the main body is provided with external threads, and an inner sidewall of the locking member is provided with a hole with internal threads matching with the external threads.

Furthermore, a third sealing ring is sleeved above the outer sidewall of the main body.

Furthermore, a fourth sealing ring is sleeved on the outer sidewall of the main body, and the fourth sealing ring is biased against an upper end surface of the locking member.

The present disclosure discloses an anti-clogging drain device, which is provided with a detachable sealing assembly and a filter ring arranged on an outer side of the switch assembly. When impurities enter the drainage channel, the sealing assembly can be detached to remove the impurities, thereby preventing clogging of the water passage.

BRIEF DESCRIPTION OF THE DRAWINGS

The drawings described herein are intended to facilitate further understanding of the present disclosure. These drawings constitute a part of the present disclosure and cannot be regarded as improper restriction to the present disclosure.

Figure 1:
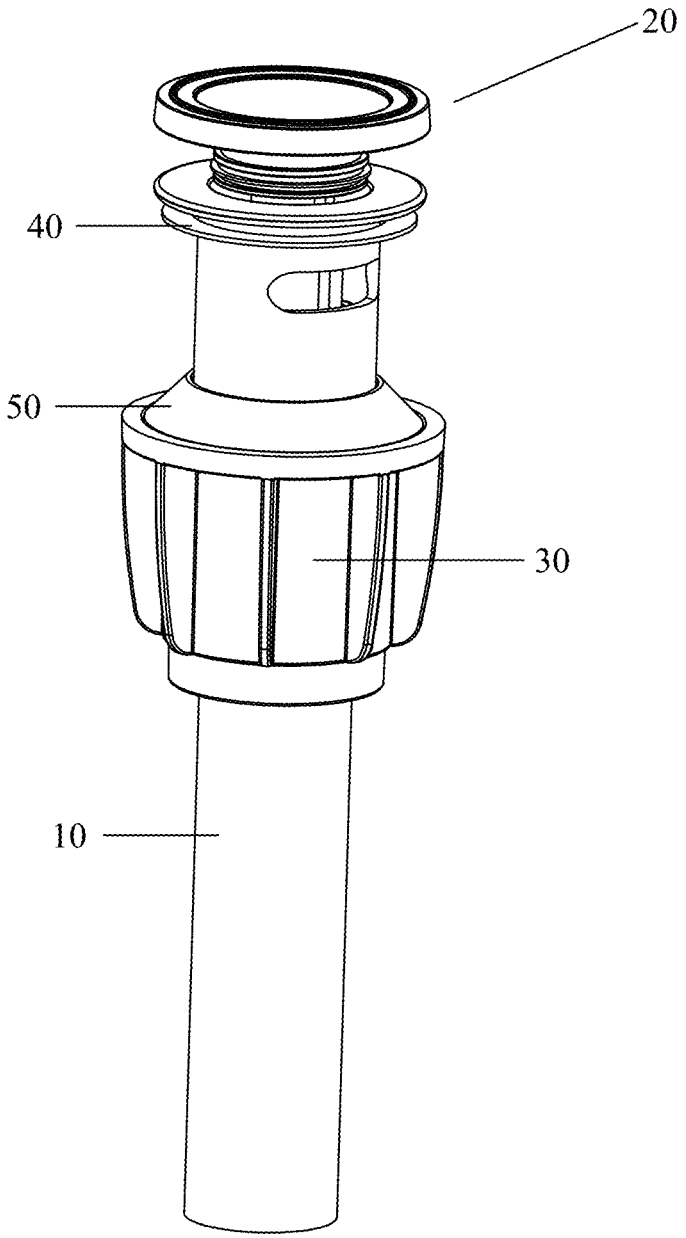
FIG. 1 is a structural schematic diagram of an anti-clogging drain device according to the present disclosure.

Reference numerals used in the drawings are listed below:

10. main body; 20. sealing assembly; 21. switch assembly; 211. base; 2111. filter ring; 2112. connection column; 2113. positioning step; 212. switching seat; 2121. switching recess; 2122. switching step; 2123. first clamping groove; 2124. second clamping groove; 2125. first switching channel; 21251. first guide surface; 21252. second guide surface; 2126. second switching channel; 21261. third guide surface; 21262. fourth guide surface; 213. switching rod; 2131. hook portion; 214. spring; 215. ring; 216. first sealing ring; 22. sealing stopper; 221. second sealing ring; 30. locking member; 40. third sealing ring; 50. fourth sealing ring.

DETAILED DESCRIPTION OF THE EMBODIMENTS

In order to enable those skilled in the art to better understand the technical solutions in the present disclosure, the technical solutions in the embodiments of the present disclosure will be clearly and completely described below in conjunction with the drawings in the embodiments of the present disclosure. Obviously, the described embodiments are only part of the embodiments of the present disclosure rather than all. Based on the embodiments in the present disclosure, all other embodiments obtained by those of ordinary skill in the art without creative effort should be considered as falling within the scope of protection of the present disclosure.

Figure 2:
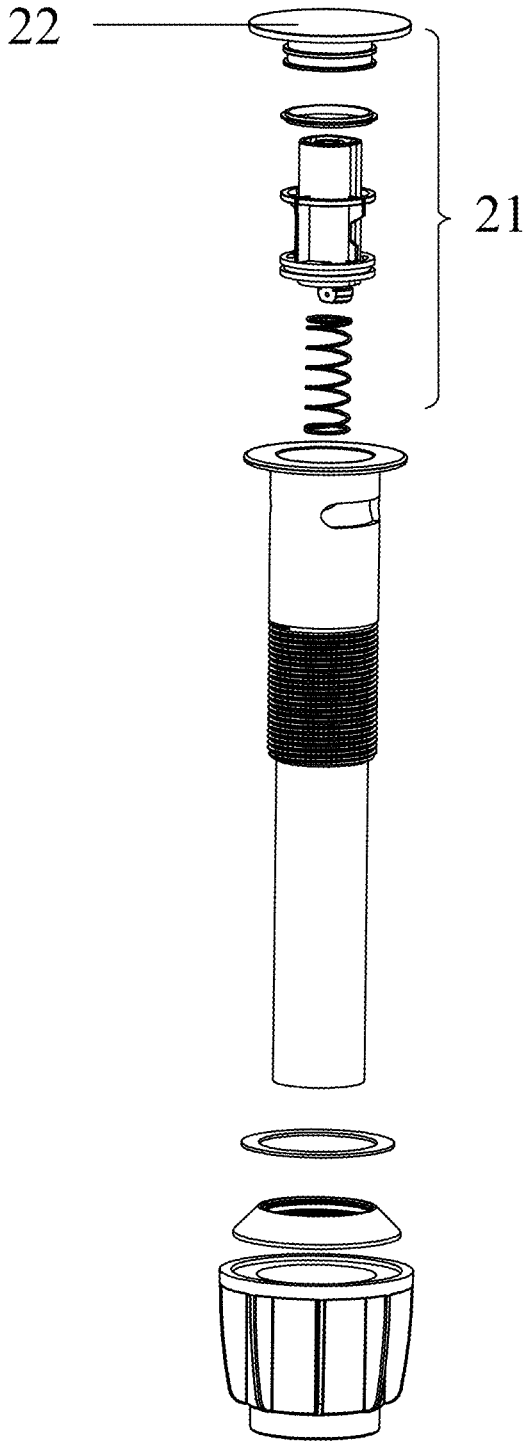
FIG. 2 is an exploded view of the anti-clogging drain device of the present disclosure.
Figure 3:
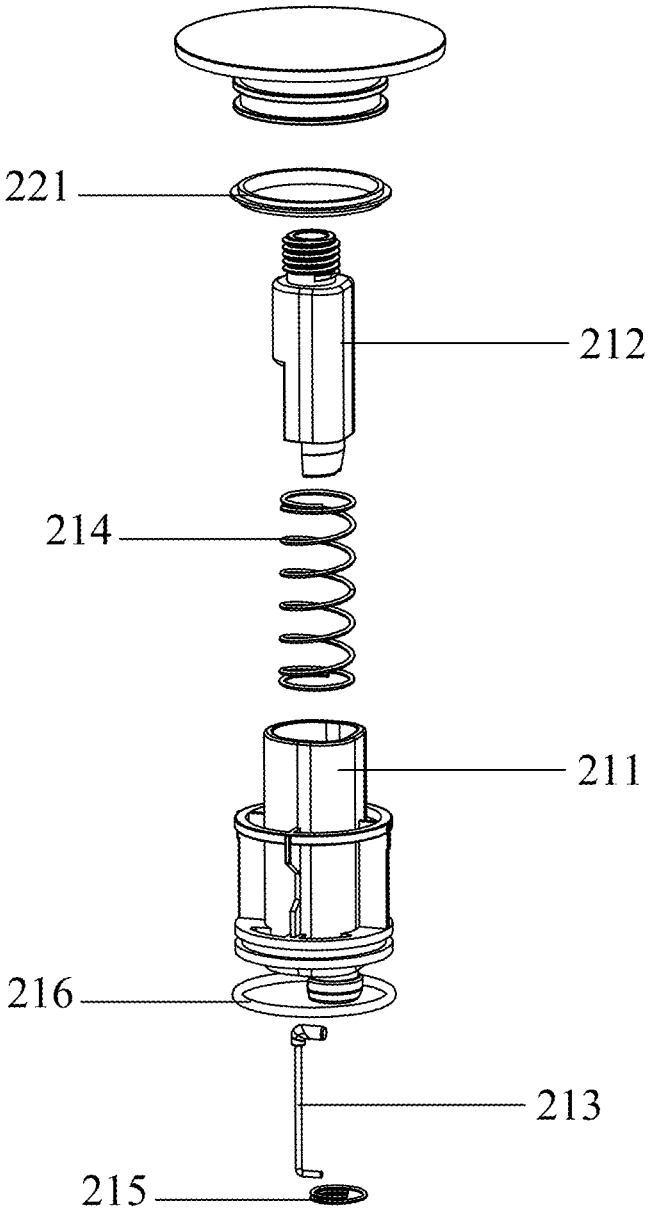
FIG. 3 is an exploded view of a sealing assembly of the present disclosure.
Figure 4:
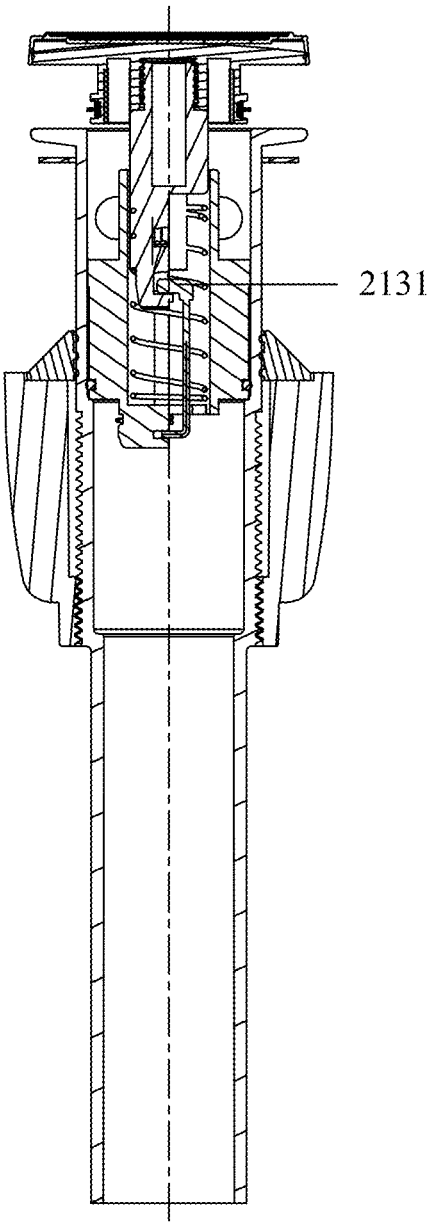
FIG. 4 is a cross-sectional view of the anti-clogging drain device of the present disclosure.
Figure 5:
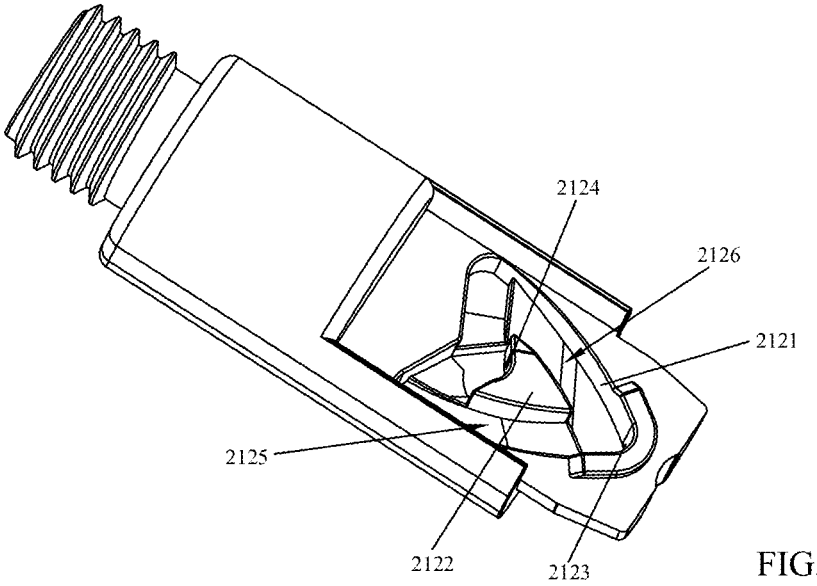
FIG. 5 is a structural schematic diagram of a switching seat of the present disclosure.
Figure 6:
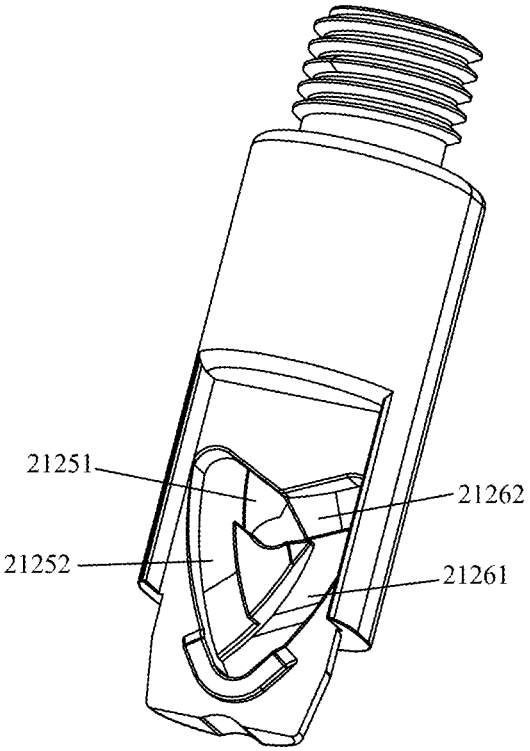
FIG. 6 is a first schematic diagram of the switching seat of the present disclosure.
Figure 7:
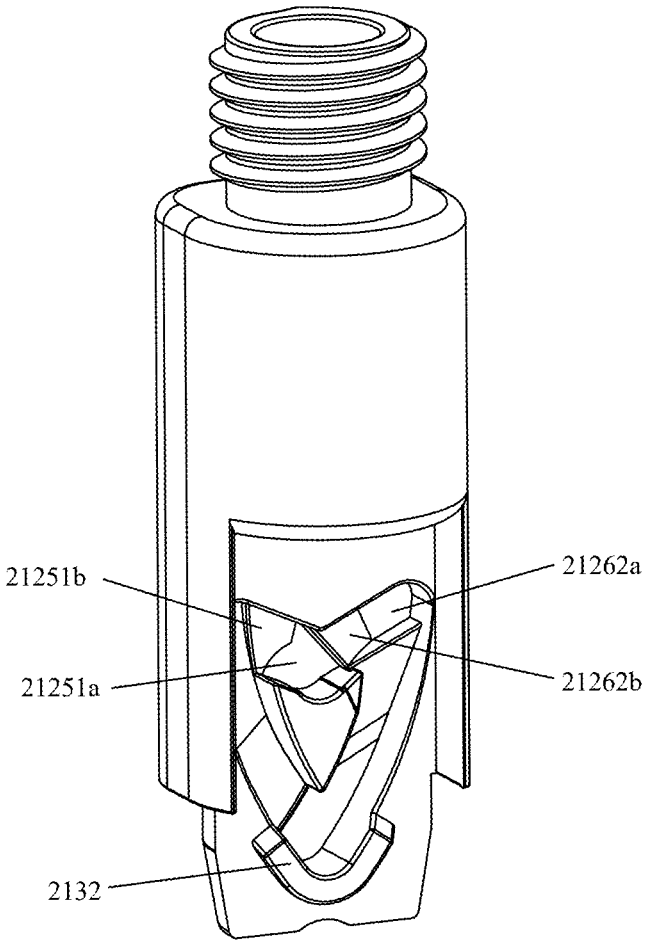
FIG. 7 is a second schematic diagram of the switching seat of the present disclosure.
Figure 8:
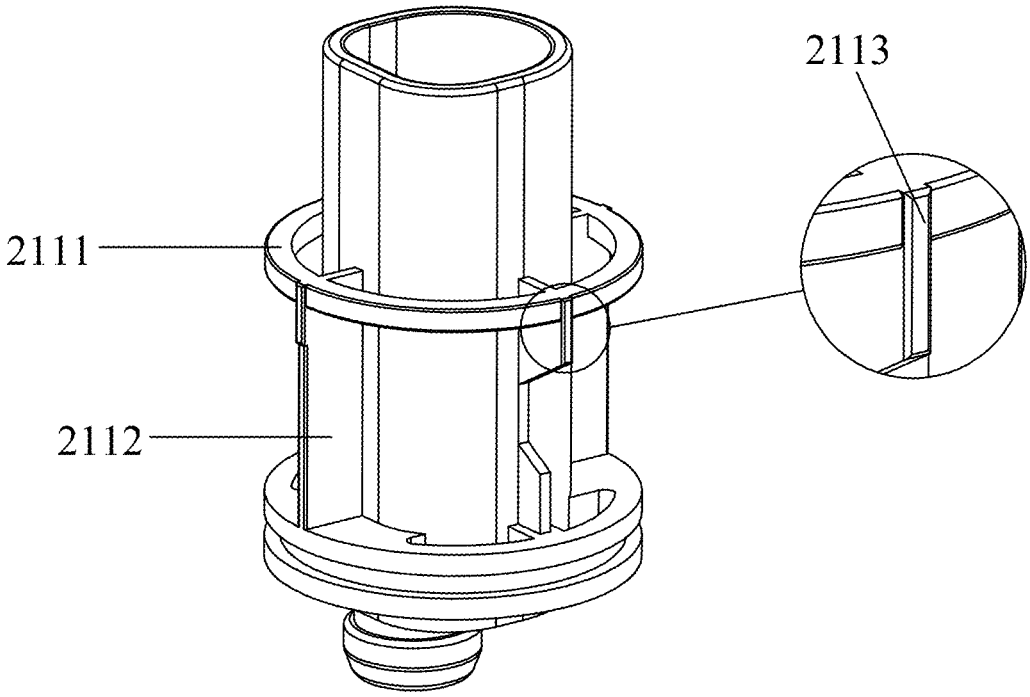
FIG. 8 is a structural schematic diagram of a base of the present disclosure.
Figure 9:
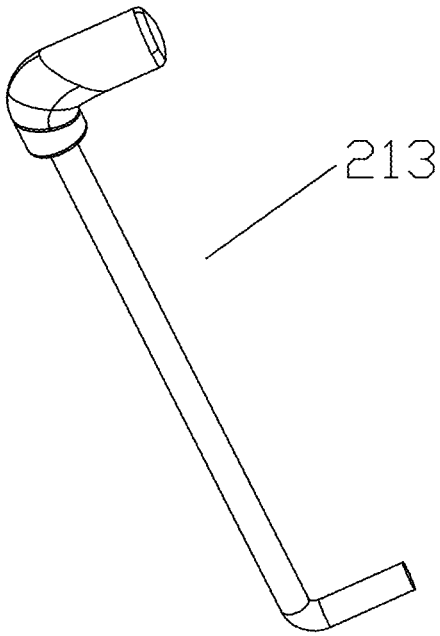
FIG. 9 is a structural schematic diagram of a switching rod of the present disclosure.

Referring to FIGS. 1-8 which show a split anti-clogging drain device provided by the present disclosure, the split anti-clogging drain device includes a main body 10 and a sealing assembly 20 detachably connected to the main body 10. The sealing assembly 20 includes a switching assembly 21 arranged inside the main body 10 and a sealing stopper 22 arranged at an opening of the main body 10 and located above the switch assembly 21. A drainage channel is formed between the switch assembly 21 and the main body 10, and a filter ring 2111 for filtering impurities is arranged on an outer sidewall of the switch assembly 21. By pressing down the sealing stopper 22, the sealing stopper 22 is repeatedly switchable between the sealed state and the drainage state under the action of the switch assembly 21.

The switch assembly 21 includes a base 211, a switching seat 212, a switching rod 213, and a spring 214. The switching seat 212 is arranged inside the base 211 and is movably connected to the base 211. A bottom part of the switching rod 213 is rotatably connected to the base 211 and an upper part of the switching rod 213 is movably connected to the switching seat 212. The spring 214 is arranged between a bottom part of an inner side of the base 211 and the switching seat 212. A sealing stopper 22 is arranged on the switching seat 212, an outer sidewall of the switching seat 212 is provided with a switching recess 2121, the switching recess 2121 is internally provided with a switching step 2122, a first clamping groove 2123 is arranged at the bottom of the switching recess 2121, and an upper end of the switching step in 2122 is provided with a second clamping groove 2124. The spring 214 continuously stores elastic potential energy, and an upper end of the switching rod 213 is provided with a hook portion 2131. When the hook portion 2131 is located in the first clamping groove 2123 and a lower end of the switching rod 213 hooks the base 211. A gap is formed between the sealing stopper 22 located above the switching seat 212 and the opening of the main body 10, the device is thereby being in a drainage state. When the hook portion is located in the second clamping groove 2124, the switching seat 212 moves downward, and the sealing stopper 22 located above the switching seat 212 is situated in the opening of the main body 10, the device is thereby being in a sealed state. Specifically, a first switching channel 2125 and a second switching channel 2126 are respectively formed between the switching recess 2121 and the switching step 2122 on two sides of the switching step 2122. When an upper end of the switching rod 213 moves downward along the first switching channel 2125 to the first clamping groove 2123, the sealing stopper 22 is in the drainage state. When the switching rod 213 moves upward along the second switching channel 2126 to the second clamping groove 2124, and the sealing stopper 22 is in the sealed state. In this embodiment, the base 211 is internally provided with a cavity for installation, and a hole for the switching rod 213 to pass through is provided at the bottom of the cavity, and an installation portion for hooking the switching rod 213 is provided at the bottom of the base 211.

Furthermore, the first switching channel 2125 includes a first guide surface 21251 and a second guide surface 21252, and the second switching channel 2126 includes a third guide surface 21261 and a fourth guide surface 21262. A joint between each pair of guide surfaces that are adjacent to each other among the first guide surface 21251, the second guide surface 21252, the third guide surface 21261 and the fourth guide surface 21262 is formed with an inward drop, namely, a joint between the first guide surface 21251 and the second guide surface 21252 is formed with a first inward drop, a joint between the second guide surface 21252 and the third guide surface 21261 is formed with a second inward drop, a joint between the third guide surface 21261 and the fourth guide surface 21262 is formed with a third inward drop, and a joint between the fourth guide surface 21262 and the first guide surface 21251 is formed with a fourth inward drop. Preferably, the guide surfaces are gradually inclined along the moving direction of the switching rod 213. When the switching rod 213 travels to the edge of the current guide surface and enters the next guide surface at the joint therebetween, due to the height difference/the drop, the switching rod 213 is guided by the next guide surface and then enters the first clamping groove 2123 or the second clamping groove 2124, so as to switch between the drainage state and the sealed state. Preferably, the fourth guide surface 21262 includes a receiving surface 21262*a* and a transition surface 21262*b*. The receiving surface 21262*a* and the transition surface 21262*b* are sequentially arranged along the moving direction of the switching rod 213 from the second switching channel 2126 upward to the second clamping groove 2124. The transition surface 21262*b* gradually inclines along the moving direction of the switching rod 213 from the joint with the receiving surface 21262*a* to form a curved surface with a concave arc. Compared with the transition surface 21262*b*, the receiving surface 21262*a* is relatively flat. The first guide surface 21251 also includes a receiving surface 21251*a* and a transition surface 21251*b*. The receiving surface 21251*a* and the transition surface 21251*b* are sequentially arranged along the moving direction of the switching rod 213 from the first switching channel 2125 downward to the first clamping groove 2123. The transition surface 21251*b* gradually inclines upward along the moving direction of the switching rod 213 from the joint with the receiving surface 21251*a*, and the transition surface 21251*b* gradually rises from the side close to the switching step 2122 to the side of the sidewall of the second guide surface 21252. Furthermore, an edge of each drop at the joint where the switching rod 213 transitions from the current guide surface to the next guide surface are provided with round chamfers, so as to increase the flexibility of the head of the switching rod 213. The inner sidewall of the switching recess 2121 at the first guide surface 21251 is obliquely inclined upward along the moving direction of the hook portion 2131, so that the hook portion 2131 can be guided into the second guide surface 21252. Further, a front end surface of the first clamping groove 2123 is provided with a retention step 2132 raised outward, and the retention step 2132 is an arc-shaped structure that bends upward at two ends, and the profile of the retention step 2132 matches the profile of the first clamping groove 2123, thereby increasing the stability of the hook portion 2131 of the switching rod 213. Further, the end surface of the hook portion 2131 is configured as a spherical surface, thereby reducing the friction between the hook portion 2131 and the sidewall of the switching recess 2121, which is conducive to the sliding of the hook portion 2131.

The base 211 is provided with a ferrule 215, and the ferrule 215 is configured below the switching rod 213. Since the lower end of the switching rod 213 hooks the base 211, under the action of the ferrule 215, the hook portion 2131 can be biased against the interior of the switching recess 2121, so as to facilitate stable switching. A first sealing ring 216 is also provided between the outer sidewall of the lower portion of the base 211 and the inner sidewall of the main body 10. Specifically, the outer sidewall of the base 211 is provided with an annular step, and the first sealing ring 216 is configured on the outer sidewall of the annular step. The annular step is provided with a through hole for passing water, and the size of the through hole can be set as required.

A drainage channel is formed between the switch assembly 21 and the main body 10, and a filter ring 2111 for filtering impurities is arranged on the outer sidewall of the switch assembly 21. Specifically, the filter ring 2111 is arranged on the outer sidewall of the base 211 in the drainage channel, and the filter ring 2111 is connected to the outer sidewall of the base 211 via a plurality of connection columns 2112. The filter ring 2111 is configured to remove impurities flowing into the drainage channel to prevent clogging of the water passage. Meanwhile, when small-sized valuable items fall into the drainage channel, the sealing assembly 20 can be gently pulled upwards to place the annular step in the opening of the main body 10, such that the items can be taken out to avoid losses. The outer sidewall of the filter ring 2111 is provided with a plurality of positioning steps 2113 which are in interference fit with the inner sidewall of the main body 10. In the present embodiment, four connection columns 2112 and four positioning steps 2113 are provided, and the positioning steps 2113 are extensions of the connection columns 2112, thereby improving the force withstand capacity of the positioning steps 2113. The outer diameter of the positioning steps 2113 is larger than or slightly larger than the inner diameter of the main body 10. The entire sealing assembly 20 is embedded in the main body 10 through interference fit, and the sealing assembly 20 is easily detachable under the action of external force to remove impurities stuck in the filter ring 2111.

The sealing stopper 22 is connected with the switching seat through threads, so that the sealing assembly 20 formed between the sealing stopper 22 and the switch assembly 21 is an integral structure. A second sealing ring 221 is sleeved on the outer sidewall of the sealing stopper 22. With the second sealing ring 221 involves in the switching, the drain device can have a sealed state and a drainage state.

The outer sidewall of the main body 10 is also provided with a locking member 30 connected thereto. Specifically, the locking member 30 is connected to the main body 10 by threads, the outer sidewall of the main body 10 is provided with external threads, and the inner sidewall of a through hole of the locking member 30 is provided with internal threads matching the external threads. A third sealing ring 40 is sleeved above the upper side of the outer sidewall of the main body 10, and a fourth sealing ring 50 is sleeved on the outer sidewall of the main body 10. The fourth sealing ring 50 is biased against the upper end surface of the locking member 30. With the arrangement of the third sealing ring 40 and the fourth sealing ring 50, the overall sealing performance of the anti-clogging drain device is improved.

In summary, the anti-clogging drain device of the present disclosure is provided with a detachable sealing assembly and a filter ring is provided on the outer side of the switch assembly. When impurities enter the drainage channel, the sealing assembly can be disassembled to remove the impurities, thereby preventing clogging of the water passage.

It should be noted that, in the present disclosure, terms such as "first" and "second" are used to distinguish one entity or operation from another entity or operation, and do not necessarily require or imply any such actual relationship or order between these entities or operations. Moreover, the terms "include", "comprise" or any other variants thereof are intended to cover non-exclusive inclusion, so that a process, method, article or device including a series of elements includes not only those elements, but also other elements not explicitly listed, or also includes elements inherent to such process, method, article or device.

Those skilled in the art will readily derive other embodiments of the present disclosure after considering the specification and implementation of the present disclosure. The present disclosure is intended to cover any variations, uses or adaptations of the present disclosure, which follow the general principles of the present disclosure and include common knowledge or customary techniques in the art that are not disclosed in the present disclosure. The specification and embodiments are intended to be exemplary only, and the true scope and spirit of the present disclosure are shown by the appended claims.

It should be understood that the present disclosure is not limited to the exact structures that have been described above and shown in the drawings, and that various modifications and changes may be made without departing from the scope thereof. The scope of the present disclosure is defined only by the appended claims.

What is claimed is:

1. A split anti-clogging drain device, comprising: a main body and a sealing assembly detachably connected to the main body;

wherein the sealing assembly comprises a switch assembly arranged inside the main body and a sealing stopper arranged at an opening of the main body and located above the switch assembly; by pressing down the sealing stopper, the sealing stopper is repeatedly switchable between a sealed state and a drainage state under an action of the switch assembly;

wherein the switch assembly comprises a switching seat, an outer sidewall of the switching seat is provided with a switching recess, the switching recess is internally provided with a switching step, a first switching channel and a second switching channel are respectively formed between the switching recess and the switching step on two sides of the switching step, the first switching channel comprises a first guide surface and a second guide surface, and the second switching channel comprises a third guide surface and a fourth guide surface, a joint between each pair of the guide surfaces that are adjacent to each other among the first guide surface, the second guide surface, the third guide surface and the fourth guide surface forms an inward drop.

2. The split anti-clogging drain device according to claim 1, wherein a drainage channel is formed between the switch assembly and the main body, and an outer sidewall of the switch assembly is provided with a filter ring for filtering impurities.

3. The split anti-clogging drain device according to claim 2, wherein an outer sidewall of the filter ring is provided with a plurality of positioning steps, and the positioning steps are in interference fit with an inner sidewall of the main body.

4. The split anti-clogging drain device according to claim 2, wherein the switch assembly further comprises a base, a switching rod, and a spring;

wherein the switching seat is arranged inside the base and is movably connected to the base; a bottom part of the switching rod is rotatably connected to the base and an upper part of the switching rod is movably connected to the switching seat; and the spring is arranged between a bottom part of an inner side of the base and the switching seat; the sealing stopper is arranged on the switching seat, a bottom part of the switching recess is provided with a first clamping groove, and an upper end of the switching step is provided with a second clamping groove.

5. The split anti-clogging drain device according to claim 4, wherein when an upper end of the switching rod moves downward along the first switching channel to the first clamping groove, the sealing stopper being in the drainage state; when the switching rod moves upward along the second switching channel to the second clamping groove, the sealing stopper being in the sealed state.

6. The split anti-clogging drain device according to claim 4, wherein a ferrule is provided on the base and the ferrule is located below the switching rod, and a first sealing ring is provided between an outer sidewall below the base and an inner sidewall of the main body.

7. The split anti-clogging drain device according to claim 4, wherein the filter ring is arranged on an outer sidewall of the base in the drainage channel, and the filter ring is connected to the outer sidewall of the base via a plurality of connection columns.

8. The split anti-clogging drain device according to claim 4, wherein a front end surface of the first clamping groove is provided with a retention step raised outward, and the retention step is an arc-shaped structure that bends upward at two ends, and a profile of the retention step matches a profile of the first clamping groove.

9. The split anti-clogging drain device according to claim 4, wherein an upper end of the switching rod is provided with a hook portion, the hook portion is located in the first clamping groove, and an end surface of the hook portion forms an arc surface.

10. The split anti-clogging drain device according to claim 1, wherein a second sealing ring is sleeved on an outer sidewall of the sealing stopper.

11. The split anti-clogging drain device according to claim 1, wherein an outer sidewall of the main body is provided with a locking member connected thereto, the locking member is connected to the main body by threads, an outer sidewall of the main body is provided with external threads, and an inner sidewall of the locking member is provided with a hole with internal threads matching with the external threads; a third sealing ring is sleeved above the outer sidewall of the main body, a fourth sealing ring is sleeved on the outer sidewall of the main body, and the fourth sealing ring is biased against an upper end surface of the locking member.

12. The split anti-clogging drain device according to claim 1, wherein an edge of each inward drop formed at the joint between each pair of the guide surfaces that are adjacent to each other among the first guide surface, the second guide surface, the third guide surface and the fourth guide surface is provided with a round chamfer.

13. The split anti-clogging drain device according to claim 1, wherein the fourth guide surface comprises a receiving surface and a transition surface, the receiving surface and the transition surface are sequentially arranged along a moving direction of the switching rod from the second switching channel upward to the second clamping groove, and the transition surface forms a curved surface with a concave arc.

* * * * *